US005358425A

United States Patent [19]

Rosen

[11] Patent Number: 5,358,425

[45] Date of Patent: Oct. 25, 1994

[54] WIRE GRIPPING ENTRYWAY FOR CONNECTOR

[75] Inventor: Anna M. P. Rosen, Austin, Tex.

[73] Assignee: Minnesota Mining and Manufacturing Company, St. Paul, Minn.

[21] Appl. No.: 94,561

[22] Filed: Jul. 20, 1993

[51] Int. Cl.[5] ..... H01R 13/58

[52] U.S. Cl. ..... 439/460

[58] Field of Search ..... 439/449, 460, 439, 402, 439/434, 441

[56] References Cited

U.S. PATENT DOCUMENTS

| | | | |
|---|---|---|---|
| 2,291,434 | 7/1942 | Hollopeter et al. | 173/324 |
| 3,388,370 | 6/1968 | Elm | 439/402 |
| 3,858,157 | 12/1974 | Bazille, Jr. | 439/400 |
| 3,878,313 | 4/1975 | Varner et al. | 174/19 |
| 3,960,431 | 6/1976 | MacKenzie et al. | 439/399 |
| 4,310,213 | 1/1982 | Fetterolf, Sr. et al. | 439/469 |
| 4,442,316 | 4/1984 | Thuermer | 174/84 |
| 4,751,350 | 6/1988 | Eaton | 174/87 |
| 4,790,772 | 12/1988 | Schulte et al. | 439/439 |
| 4,897,046 | 1/1990 | Tengler et al. | 439/579 |
| 5,107,077 | 4/1992 | Fox et al. | 174/138 |
| 5,113,037 | 5/1992 | King, Jr. et al. | 439/449 |
| 5,176,545 | 1/1993 | Brown | 439/885 |
| 5,195,913 | 3/1993 | Shattuck | 439/246 |

FOREIGN PATENT DOCUMENTS

| | | | |
|---|---|---|---|
| 936588 | 9/1963 | United Kingdom | 439/460 |

*Primary Examiner*—Gary F. Paumen

*Attorney, Agent, or Firm*—Gary L. Griswold; Walter N. Kirn; David W. Anderson

[57] ABSTRACT

A wire gripping entryway particularly adapted for use with an electrical connector capable of making an electrical connection to a cylindrical, insulated electrical wire inserted into the connector includes a wall having an inner surface defining an hole in the connector for the entrance of the electrical wire, a first set of resilient projections extending a first distance radially inwardly from the inner surface of the wall for gripping a wire having a diameter within a first range of diameters and a second set of resilient projections extending a second distance greater than the first distance radially inwardly from the inner surface of the wall for gripping a wire having a diameter within a second range of diameters.

3 Claims, 2 Drawing Sheets

Fig. 2
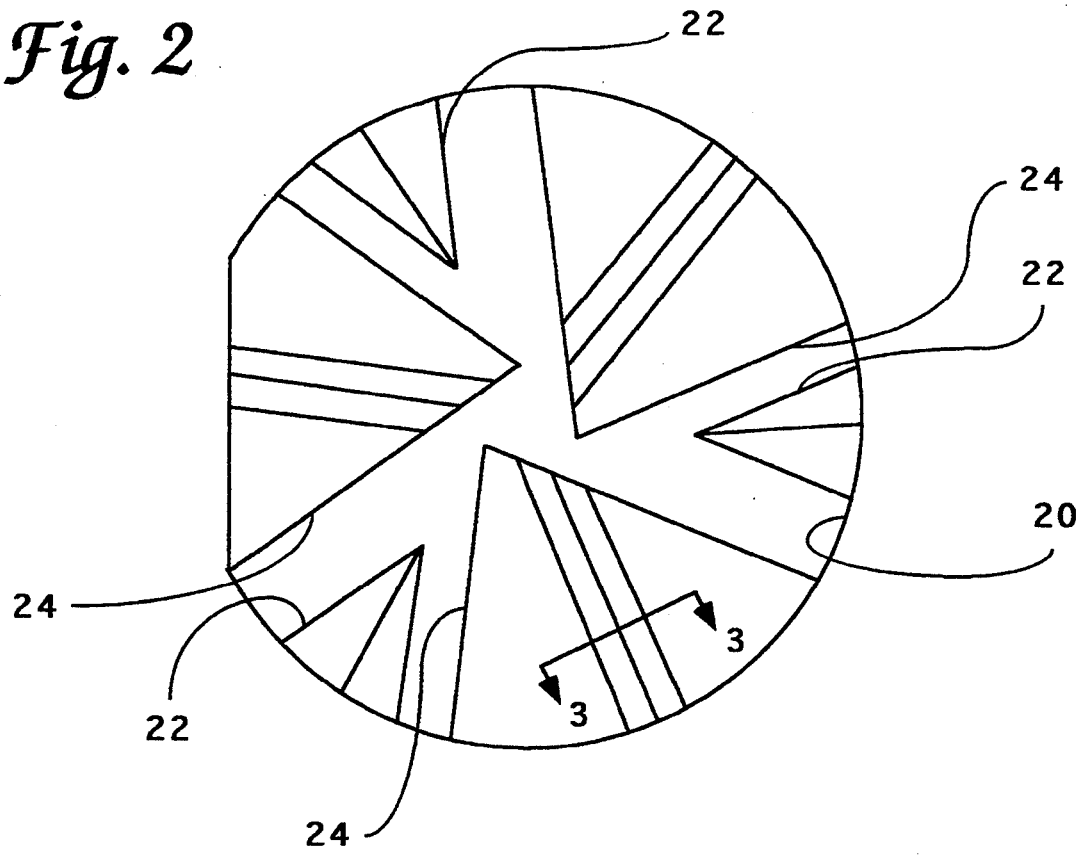
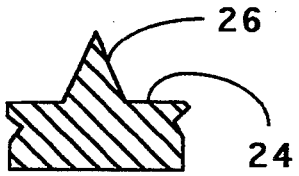
Fig. 3

WIRE GRIPPING ENTRYWAY FOR CONNECTOR

FIELD OF THE INVENTION

The present invention relates generally to electrical connectors, and more particularly to connectors intended for use with insulated electrical wires and having insulation-piercing contacts.

BACKGROUND OF THE INVENTION

Connectors such as those described in U.S. Pat. Nos. 3,388,370 and 3,858,157 permit the solderless splicing of insulated wires in either pigtail, tap or in-line modes. The connector comprises an insulating body having two or more longitudinal wire-receiving channels which are transversely grooved for insertion of a slotted metal contact plate. A wire is inserted into each channel of the connector and the contact plate is forced into engagement with the wires. The contact plate has insulation-displacing grooves which cut through the insulation of the wires to make contact with each wire and connect them electrically to each other.

It is important that the wires be inserted into the channels of the connector to the depth necessary for proper engagement with the contact plate. It is sometimes difficult to manipulate the wires to ensure that the wires are properly positioned prior to making the connection, particularly when connections between multiple wires are being attempted simultaneously.

SUMMARY OF THE INVENTION

The present invention helps ensure wires are properly positioned within the connector by providing a wire gripping entryway including a wall having an inner surface defining a hole in the connector for the entrance for an electrical wire, a first set of resilient projections extending a first distance radially inwardly from the inner surface of the wall for gripping a wire having a diameter within a first range of diameters, and a second set of resilient projections extending a second distance greater than the first distance radially inwardly from the inner surface of the wall for gripping a wire having a diameter within a second range of diameters.

There are preferably three projections in each set of projections and also preferably the projections forming each set are alternately disposed around the inner surface of the hole. The projections are preferably triangular in shape with a side attached to the inner surface of the hole and a point extending toward the center of the hole. The points of the projections may be offset from the center of the hole so that the wire is engaged by a side of the triangular shape adjacent the point of the projection. This wire-engagement side may include ridges for increasing the grip of the projections on the wire. The point of the projection may be truncated so that a flat end of the projection grips the wire, and the truncated end may include serrations which enhance the grip of the projections on the wire.

BRIEF DESCRIPTION OF THE DRAWINGS

The present invention will be more thoroughly described with respect to the accompanying drawings, wherein like numbers refer to like parts in the several views, and wherein:

FIG. 2 is a plan view of a wire gripping entryway according to the invention; and FIG. 3 is a cross-sectional view taken generally along the line 3—3 of FIG. 2.

DESCRIPTION OF THE PREFERRED EMBODIMENT

Figure 1:
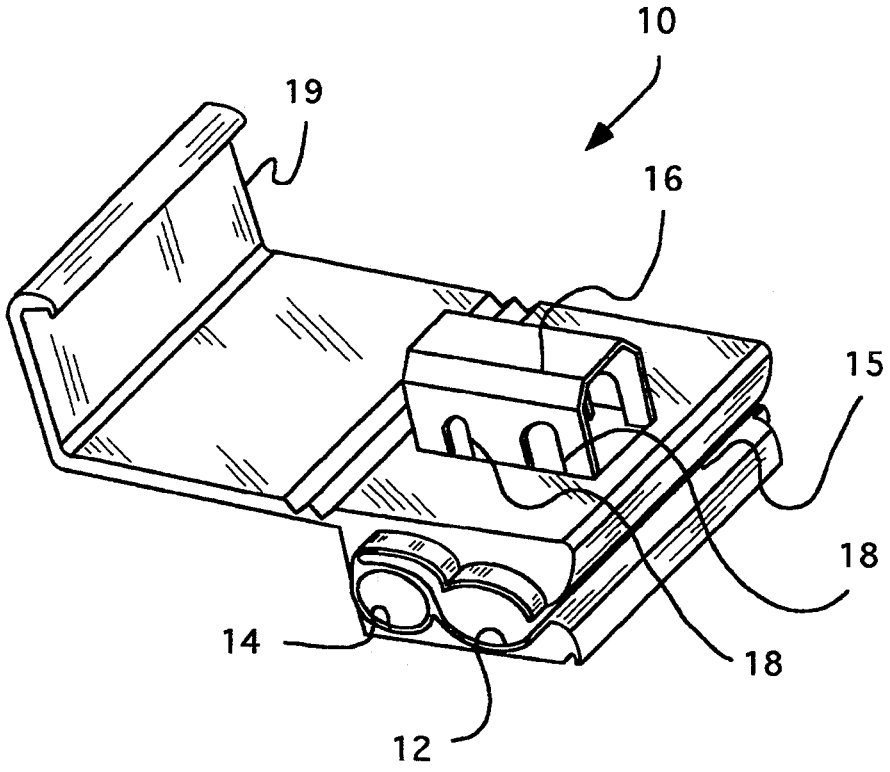
FIG. 1 is a perspective view of an electrical connector which may advantageously employ the present invention.

FIG. 1 illustrates an electrical connector 10 similar to that described in U.S. Pat. No. 3,388,370. The connector 10 includes a through hole 12 and a blind hole 14 parallel to the through hole 12. The holes 12 and 14 accept insulated electrical wires which are intended to be electrically connected to each other. The through hole 12 may be accessed by means of a slit 15 in the side of the connector 10 so that a wire can be laid in the through hole 12 from the side rather than pushed into the hole 12. The connector 10 is thus useful in making a tap connection between a run or through wire disposed in the through hole 12 and the end of another wire inserted into the blind hole 14. A connection between the ends of two wires could also be accomplished, of course.

The connector 10 is provided with a slotted metal contact plate 16 which makes the actual electrical contact between the two wires. The slots 18 in the contact plate 16 are designed to cut through the insulation of the wires and engage the conductors as the contact plate 16 is forced into contact with the wires. After the contact plate 16 is forced downwardly to the point where its top is even with the top surface of the connector 10, a hinged cover 19 is folded over the contact plate 16 and latched to the side of the connector 10.

To successfully accomplish a connection between two wires it is necessary to ensure that both wires are inserted deeply enough into the connector 10 to be engaged by the contact plate 16. This is not too difficult if the connection is to be one between a through wire and the end of another, since the through wire simply extends completely through the connector and only the other wire must be held within the blind hole 14. However, if a connection is attempted between two wire ends, or the connector is designed to accommodate more that two wires, the task becomes more difficult. It is necessary for the user to manipulate and maintain the wires in the proper position while simultaneously forcing the contact plate 16 toward the wires with a tool.

The present invention is designed to facilitate the making of a connection of the types described by providing a feature within at least the blind hole 14 which retains the wire in its inserted position so that the user can release the wire and concern herself only with completing the connection between the wires. The invention is shown in FIGS. 2 and 3. FIG. 2 illustrates the inner surface 20 of the blind hole 14 and two sets of projections 22 and 24 extending from the inner surface 20 of the hole 14. The first set of projections 22 have a three-sided pyramidal shape and are attached at their bases to the inner surface 20 of the hole 14. The first projections 22 come to a point which is directed toward the center of the hole 14. The second set of projections 24 are substantially planar triangles, again with the bases of the projections 24 attached to the inner surface 20 of the hole 14 and the apex of the triangular shape extending toward the center of the hole 14. The apexes of the second projections 24 are shown offset from the center of the hole 14, which is preferred, but they may be directed at the center as are the first set of projections 22.

The projections 22 and 24, and preferably the connector 10 also, are made of a resilient polymeric material, and are designed to be resiliently deformed by the passage of a wire and grip the insulation of the wire to prevent its removal. The second set of projections 24, the larger ones, are provided to capture a first range of wire diameters which may be used with the connector 10. The projections 24 are shaped so that the apexes of the projections are offset from the center of the hole 14 so that an inserted wire contacts the sides of the projections 24 and thus is engaged by a greater portion of the projection 24 than a point. The side of the projection which engages the wire may be provided with a ridge 26 to further increase the amount of engagement between the projections 24 and the wire. More than the one ridge 26 could be provided on each of the projections 24.

As mentioned earlier, the projections 24 could be formed in a shape which caused the apexes to be directed at the center of the hole 14. Further, the ends could be truncated to produce an edge which would dig into the insulation of an inserted wire, and this truncated edge could be serrated to increase the engagement between the projections 24 and the wire.

It will be recognized that as wire diameter increases, the second set of projections 24 will be deformed more and more until they are no longer effective to engage the wire. This is why the connector is provided with the first set of projections 22. A large diameter wire will bend the second set of projections 24 back until they are ineffective to engage the wire, but such a Wire will be engaged by the first set of projections 22. It is possible and desirable that the ranges of wire diameters which may be accommodated by the two sets of projections 22 and 24 overlap to a small extent.

The projections 22, like the projections 24, are manufactured of a resilient polymer, preferably the same polymer as the connector 10, and are preferably formed as an integral part of the connector 10 as it is molded. The first set of projections 22 are preferably shaped as a three-sided pyramid with its base attached to the inner surface 20 of the hole 14. It is possible to form the first set of projections 22 as planar triangles like the second set of projections 24, if the thicknesses of the projections 22 are such that required resiliency and strength is retained.

The present invention has been described with respect to only a single preferred embodiment, although modifications will be apparent to those skilled in the art. For example, the sets of projections 22 and 24 need not include three projections each, although a number and an arrangement should be used which maintains the wire in the center of the hole 14. Thus an odd number of projections in each set arranged symmetrically around the inner surface of the hole is preferred. The wire-gripping projections 22 and 24 may be shaped other than as shown, such as with truncated smooth or serrated apexes as mentioned above. Also, the two sets of projections 22 and 24 need not be in the same plane as illustrated. Although the projections 22 and 24 have been described particularly with respect to the blind hole 14, it should be recognized that the projections 22 and 24 could be equally well applied to the through hole 12. In the application of the projections to the through hole 12, however, one or more of the projections 22 and/or 24 will not exist to provide for the slit 15 in the side of the connector 10. Also, the projections 22 and 24 can be located anywhere along the length of either hole 12 or 14, provided the projections 22 and 24 are spaced sufficiently from the end of the blind hole 14 to allow for deformation of the projections 22 and 24 and gripping of the wire. Finally, the projections 22 and 24 have more general applicability than use in the particular connector 10 shown. They may be formed as a part of any device in which it would be advantageous to retain a cylindrical object with a relatively soft exterior in a hole.

I claim:

1. A wire gripping entryway for gripping a cylindrical, insulated electrical wire and particularly adapted for use with an electrical connector comprising:

a wall having an inner surface defining a substantially circular hole for insertion of the electrical wire;

a first set of resilient projections, each projection being triangular in shape with one side attached to said wall inner surface and an apex of said triangular shape extending a first distance radially inwardly from said inner surface of said wall for gripping a wire having a diameter within a first range of diameters;

a second set of resilient projections, each projection being triangular in shape with one side attached to said wall inner surface and an apex of said triangular shape extending a second distance greater than said first distance radially inwardly from said inner surface of said wall for gripping a wire having a diameter within a second range of diameters;

wherein said apexes of said second set of projections are offset from the centerline of said hole so that a wire inserted into said hole is engaged by a side of each of said triangular projections.

2. A wire gripping entryway according to claim 1 wherein said second set of projections further includes ridges disposed at said sides of said projections engaging the wire to enhance the engagement of said projections with a wire inserted into said hole.

3. In a connector assembly for making solderless inline, pigtail or tap electrical connections between insulated wires and comprising a base having parallel longitudinal wire-supporting channels including an inner surface defining a hole and being grooved transversely of said channels, and a resilient slotted metal plate contact element fitting within a said groove and with slots in alignment with said wire-supporting channels, the improvement comprising wire-gripping projections associated with at least one of said channels including a first set of resilient projections extending a first distance radially inwardly from said inner surface of said channel for gripping a wire having a diameter within a first range of diameters and a second set of resilient projections extending a second distance greater than said first distance radially inwardly from said inner surface of said channel for gripping a wire having a diameter within a second range of diameters.

* * * * *